United States Patent [19]

Delafield

[11] Patent Number: 4,987,713

[45] Date of Patent: Jan. 29, 1991

[54] TECHNIQUE FOR MOUNTING PANELS FOR FURNITURE

[76] Inventor: Fredrick B. Delafield, 2406 Goldfield Ct., Greensboro, N.C. 27408

[21] Appl. No.: 260,916

[22] Filed: Oct. 21, 1988

[51] Int. Cl.[5] ..... E04B 1/62

[52] U.S. Cl. ..... 52/400; 52/823

[58] Field of Search ..... 52/400, 823, 397; 428/31

[56] References Cited

U.S. PATENT DOCUMENTS

| | | | |
|---|---|---|---|
| 2,176,143 | 10/1939 | Miller | 52/400 |
| 2,831,553 | 4/1958 | Pollock | 52/400 |
| 2,853,748 | 9/1958 | Kessler | 52/400 |
| 3,023,859 | 3/1962 | Muessel | 189/34 |
| 3,438,166 | 4/1969 | Bakke | 52/400 |
| 3,715,847 | 2/1973 | Straus | 52/400 |
| 3,732,659 | 5/1973 | LaBarge | 52/400 |
| 3,922,460 | 11/1975 | Jackson | 428/31 |
| 3,982,371 | 9/1976 | Preu | 52/498 |
| 4,006,569 | 2/1977 | Kain | 52/397 |
| 4,018,022 | 4/1977 | Fink | 52/400 |
| 4,132,044 | 1/1979 | Rollyson | 52/775 |
| 4,151,696 | 5/1979 | Knights et al. | 52/741 |
| 4,240,235 | 12/1980 | Nawa | 52/397 |
| 4,364,209 | 12/1982 | Gebhard | 52/400 |
| 4,376,359 | 3/1983 | Redman | 52/127 |
| 4,548,843 | 10/1985 | Kozaka | 428/31 |
| 4,561,223 | 12/1985 | Gold | 52/400 |
| 4,703,598 | 11/1987 | Wilson et al. | 52/238.1 |

FOREIGN PATENT DOCUMENTS

| | | | |
|---|---|---|---|
| 710081 | 5/1965 | Canada | 52/400 |
| 1231787 | 10/1960 | France | 52/400 |
| 2370159 | 7/1978 | France | 52/400 |
| 828278 | 2/1960 | United Kingdom | 52/400 |

*Primary Examiner*—Henry E. Raduazo

*Attorney, Agent, or Firm*—Rhodes, Coats & Bennett

[57] ABSTRACT

A frame and strip assembly for mounting an edge portion of a panel. The assembly includes a frame member having a channel-like recess for receiving the edge portion of the panel and a mounting strip adapted to be received in the recess. The strip includes a base and a pair of opposed side walls defining a generally U-shaped cross section. The upper portion of each of the side walls of the mounting strip defines a transversely extending wing-like flange. The flanges and the side walls of the mounting strip are in a substantially continuous and coextensive engagement with the frame member adjacent to the recess and the panel to suspend the edge portion of the panel in the frame member and to firmly secure the edge portion of the panel in the mounting strip, thereby both preventing contact between the panel edge and the frame member and movement between the panel edge and the mounting strip.

36 Claims, 2 Drawing Sheets

TECHNIQUE FOR MOUNTING PANELS FOR FURNITURE

BACKGROUND OF THE INVENTION (1) Field of the Invention

The present invention relates generally to the mounting of panels in frames and, in particular, to an improved panel mounting strip for mounting glass panels in a frame member.

(2) Description of the Prior Art

Panels, including panels formed of window glass, mirrors, or the like, are often mounted in metal frames having an elongated channel member which incorporates a resilient gasket in the channel to protect the edge of the panel and to aid in securing the panel and the channel member.

The assembly of the frame and panel is normally accomplished in one of three ways. In the first method, the resilient gasket is placed by hand about the edge of the panel and then the panel and the gasket are inserted into the channel member. The dimensions of the channel member and the resilient gasket are such that the panel is snugly received by the channel member. One example of such a panel mounting method is shown in U.S. Pat. No. 4,240,235 issued to Nawa. However, during assembly the gasket may become distorted or misaligned in relation to the panel edge and channel. Such gasket misalignment may result in undesirable stretching or compression of the gasket which is unsightly and which can adversely effect the protection of the panel edge and the channel. Normally, the panel and frame must be disassembled and assembly repeated. Accordingly, a relatively high level of skill has been required to effect the proper assembly of the panel, gasket and frame.

The second method for assembling the panel frame includes the step of prepositioning the gasket in the mounting frame and then inserting the panel edge. One example of such a panel mounting method is shown in U.S. Pat. No. 4,006,569, issued to Kain. However, it has been found that the gasket may still be disformed during the assembly process so that it is improperly positioned in the channel member to protect and seal the panel edge therein.

The third method of mounting a panel, includes prefabricating a frame having a front molding, inserting the panel up against the front molding, and then securing the panel within the frame by the addition of a second inner molding which presses the panel against the first molding. This technique is most often used in the furniture industry because the finished front molding produces the most aesthetically pleasing appearance. However, this mounting method is extremely time-consuming, requires use of skilled labor, and the panel is prone to rattling between the moldings.

It has thus become desirable to develop a panel mounting which contains the simplicity of the first panel mounting method of placing the gasket by hand at the edge of the panel and then inserting the panel and gasket assembly into the channel member, while at the same time, employing the advantage of the second method in which the panel mounting gasket is prevented from being misaligned while the panel edge and frame are being assembled. In addition, the panel mounting should also be aesthetically pleasing to be useful in the construction of furniture products.

SUMMARY OF THE INVENTION

The present invention solves the aforementioned problems associated with the prior art by providing a method and apparatus for mounting panels, such as glass or mirrors or the like in a frame which may be subsequently assembled into a piece of furniture, such as a curio cabinet. The present invention includes a frame member having an elongated channel-like recess and a panel mounting gasket strip which is adapted to receive one edge of the panel and, furthermore, is adapted to be securely received within the channel-like recess. The panel mounting strip is made from a semirigid PVC plastic extrusion having a durometer value of approximately 80.

In the preferred embodiment, the strip is characterized by a cross-sectional shape which includes a "U" shaped body having a pair of wing-like flanges attached to each leg of the "U" shaped body. The wing-like flanges are inclined slightly inwardly (approximately 15°) which serves both to align and hold an inserted panel during assembly. The high durometer panel mounting strips are sufficiently resilient to be snapped onto the panel to permit easy assembly, however, will not distort while the panel and panel mounting strip assembly is being positioned within the channel-like recess. In addition, it has been found that the wing-like flanges provide a pleasing visual effect, whereby the panel member appears thicker than it actually is.

Accordingly, one aspect of the present invention is to provide a method and apparatus for mounting panels in a frame that permits the rapid assembly of the panels in the mounting frames while, at the same time, requiring a lower degree of skill then previously required.

Another aspect of the present invention is to provide a panel mounting strip which is operable to protect and secure the edge of the panel, while at the same time, resists deformation during assembly, and provides a pleasing appearance.

These and other aspects of the present invention will be more clearly understood after a review of the following description of the preferred embodiment of the invention, when considered with the drawings.

DESCRIPTION OF THE PREFERRED EMBODIMENT

Figure 1:
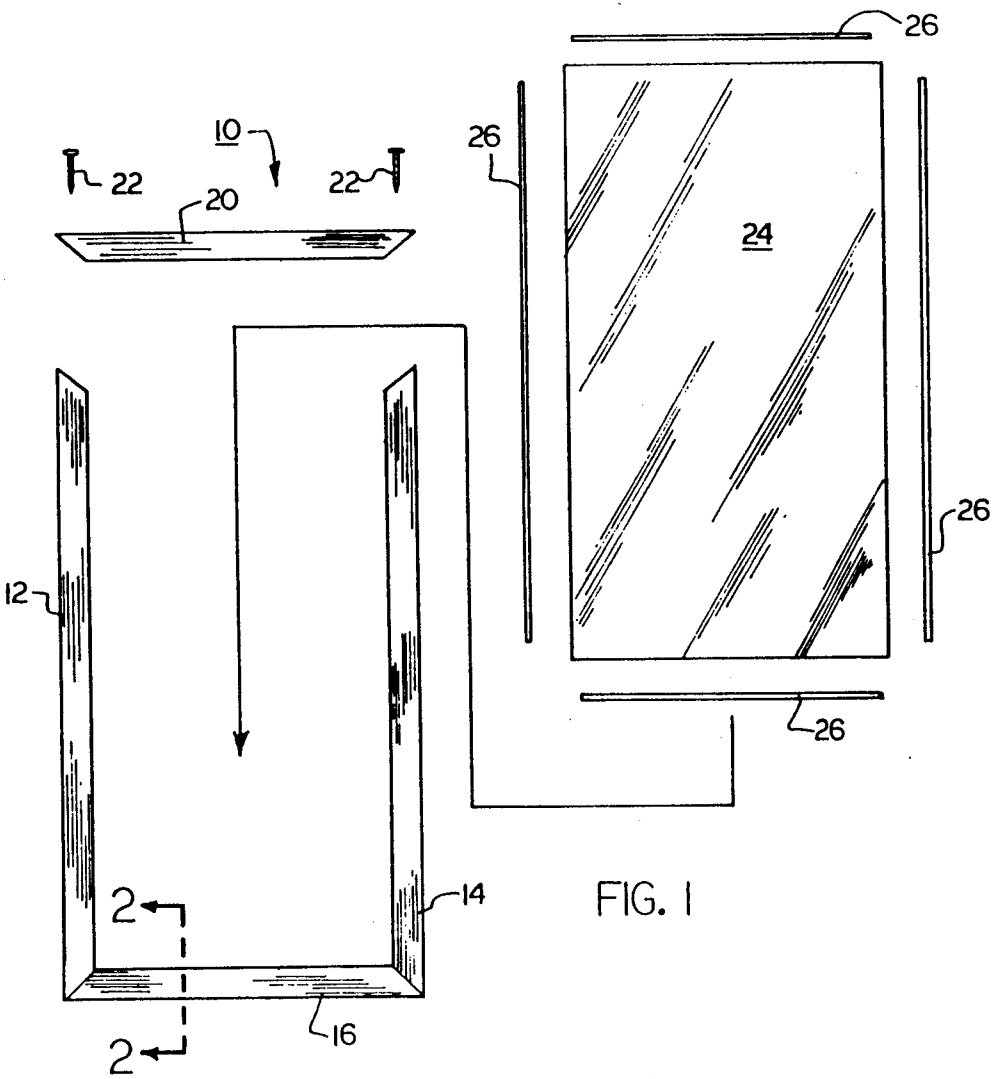
FIG. 1 is an exploded view of a panel assembly utilizing the present invention.

Referring now to the drawings in general and to FIG. 1 in particular, it will be understood that the illustrations are for the purpose of describing a preferred embodiment of the invention and are not intended to limit the invention hereto. Certain terminology will be used in the following description for convenience and reference only, it will not be limiting. For example, the words "upwardly", "downwardly", "rightwardly", "leftwardly", refer to the direction in the drawings in which reference is made. The words "inwardly" and "outwardly" will refer to directions into and away from, respectively, the geometric center of the wall to the panel structure and designated parts thereof. Such terminology will include the words specifically mentioned, derivatives thereof, and words similar in part.

As best seen in FIG. 1, a panel assembly, generally designated 10, is shown utilizing the frame and panel mounting strip of the present invention. Panel assembly 10 includes a pair of side frames 12, 14 which are attached by suitable means to bottom frame 16. Side frames 12, 14 and bottom frame 16 are normally made of brass, however, other materials, such as aluminum or other metals that can be manufactured by machining or extrusion process, can also be used. Side frames 12, 14 and bottom frames may be attached to one another by welding or brazing or other suitable attachment means such as fasteners. Panel assembly 10 also includes a removable top frame portion 20 which is attachable to the upper portion of side frames 12, 14 by means of fasteners 22. Panel member 24 can be any generally flat material including glass, mirrors, wood, plastic, or the like. Panel mounting strip 26 is precut based on the outer dimensions of panel member 24 prior to assembly.

Figure 2:
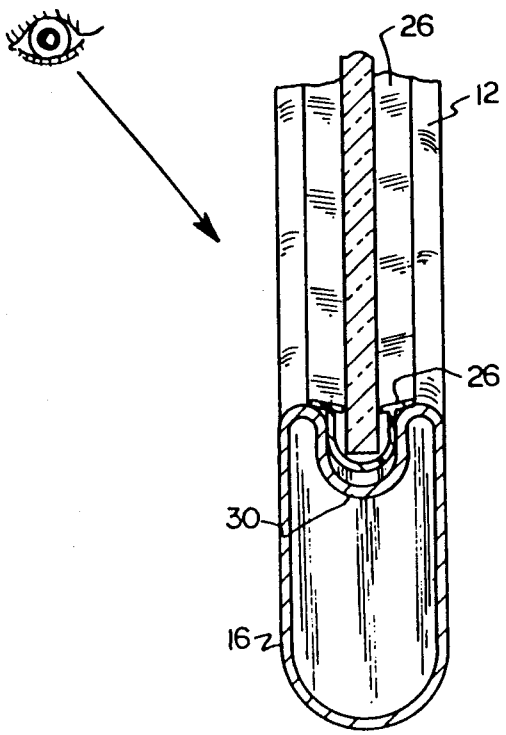
FIG. 2 is an enlarged cross-sectional view of the panel assembly of FIG. 1, taken along line 2—2; this view illustrating the panel mounting solely diagrammatically.

Turning now to FIG. 2, it can be seen that frame elements 12, 14, 16 and 20 include an upwardly-opening channel-like recess 30. This channel-like recess 30 accommodates therein the panel mounting strip 26, according to the present invention. Panel mounting strip 26, in turn, supports and secures the edge of panel member 24 without the need for additional assemblies. This, in effect, makes panel assembly 10 particularly desirable for furniture applications. In addition, it has been surprisingly discovered that panel mounting strip 26 of the present invention provides a unique visual appearance wherein panel 24 appears thicker than it actually is. This effect is most noticeable between 30 and 70° normal to the panel 24.

Figure 3:
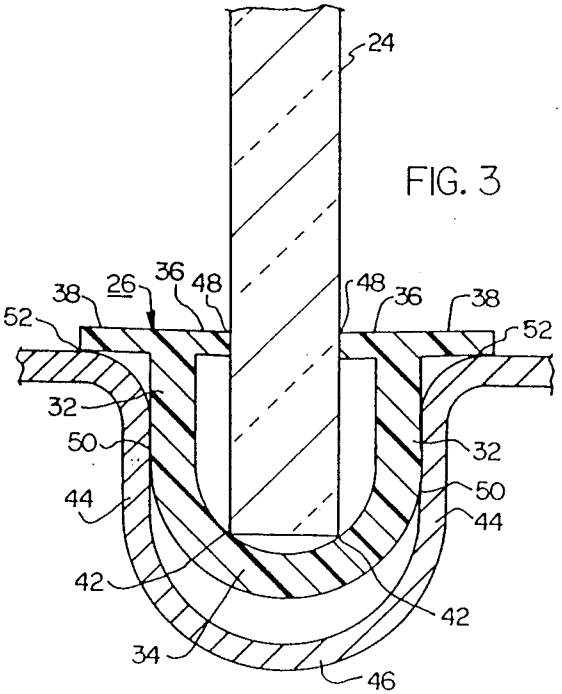
FIG. 3 is an enlarged cross-sectional view, similar to FIG. 2. but illustrating the geometry and structural cooperation of the present invention.

Turning now to FIG. 3, it can be seen that the panel mounting strip 26 includes a pair of approximately parallel sidewalls 32 which are of substantial vertical extent and which, adjacent one end thereof, are joined by a base portion 34 which extends therebetween. The sidewalls 32 hence project upwardly in a cantilevered fashion from the base portion 34 and, adjacent their upper or outer free ends, are provided with wing-like flanges 36, 38 which project both inwardly and outwardly with respect to the channel opening 40 defined between the generally parallel sidewalls 32. Channel-like recess 30 includes a pair of opposed sidewalls 44, which are of substantial vertical extent, and which, adjacent when thereof, are joined together by a base portion 46 extending generally perpendicular therebetween. The sidewalls 44 project upwardly in a generally cantilevered fashion from the base portion 46.

Figure 4:
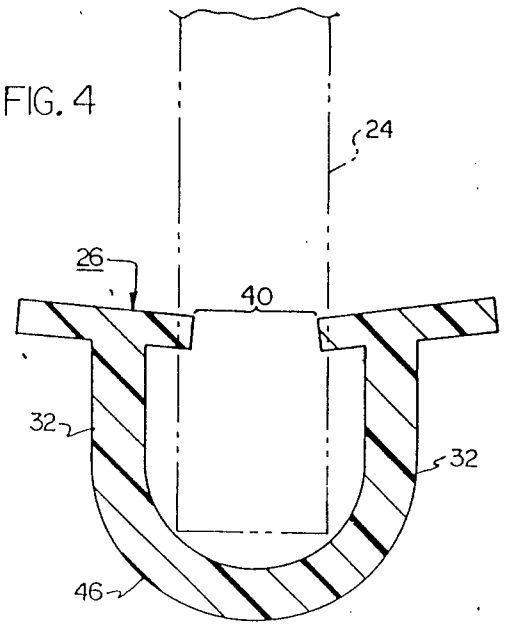
FIG. 4 is a cross-sectional view of the preferred embodiment of the panel mounting strip of the present invention in a non-deformed condition.

As best illustrated by FIG. 4, when the panel mounting strip 26 is in a non-deformed condition, the sidewalls 32 of panel mounting strip 26 preferably project inwardly and in a slightly downwardly converging relationship with one another so that the opening 40 as defined by the upwardly extending sidewalls 32 are slightly larger than the recess 30 formed in frame 16. Similarly, the width between the winglike flanges 36, when strip 26 is in a non-deformed condition is, preferably less than the width of the panel member 24.

The panel mounting strip 26 is preferably extruded of a plastic material in the form of a elongated strip so that a single panel mounting strip 26 may be cut to length so as to extend completely along the perimeter of the panel member 24. By extruding the panel mounting strip from a plastic material, the panel mounting strip 26 possesses a limited amount of resiliency so as to permit the opposed pairs of wing-like flanges 36 to be suitably resiliently deformed with the flanges themselves being able to achieve a snug sealing engagement with the panel member 24 and the sidewalls 44 of the channel-like recess 30 which they contact along seal points, 48 and 50, 52, respectively.

The panel mounting strip 26 of the present invention is preferably constructed of a semi-rigid transparent polyvinyl chloride PVC plastic, such as stock number 87446-001 available from B. F. Goodrich of Akron, Ohio. In the preferred embodiment, the thickness of the sidewalls 36 is approximately 0.040 inches. The thickness of the inner flanges 36 is approximately 0.030 inches.

Thus, to assemble the panel assembly 10, panel mounting strip 26 is first cut into a plurality of elements approximately equal in length to the perimeter of panel member 24. Each segment of panel mounting strip 26 is then positioned adjacent to the edge of panel member 24. Then the edge of panel member 24 is inserted between the pair of wing-like flanges 36, the side-wall portions 32 are resiliently deflected outwardly so as to accommodate the width of the panel 24. The tips of the wing-like flanges 36 will sealingly engage the opposite sides of the panel member 24 at seal points 42, 48. In this manner, the seal points 42, 48 prevent dust from being transmitted around the outside of the panel member 24.

The panel member 24 and panel mounting strip 26 sub-assembly is then inserted between side frames 12 and 14 and moved downwardly towards bottom frame 16. The upper ends of side frames 12, 14 opposite bottom frame 16 will spread sufficiently to allow the subassembly to be inserted, however, as the sub-assembly moves closer to the bottom frame 16, there will be less accommodation. Accordingly, opposed sidewalls 44 of channel-like recess 30 will press against the pair of opposed sidewall portion 32 at seal points 50, 52 which will cause the sidewalls 32 to be resiliently deflected inwardly, whereupon the outer surface of legs 32 will sealingly engage the opposed sidewalls 44 of channel-like recess 30. In this manner, seal points 50, 52 also prevent dust from being transmitted between the edges of the panel mounting strip 26 and the channel-like recess.

After the panel member 24 and panel mounting strip 26 sub-assembly has been inserted and abutted against bottom frame 16, top frame 20 may be positioned adjacent to the opposite end of side frames 12 and 14 and attached by fasteners 22 or other suitable means.

Thus, when the panel assembly 10 is completed, the channel-like recess 30, panel member 24 and panel mounting strip 26 cooperate to produce a structure which both supports and secures the panel member 24 within side, bottom and top frames 12, 14, 16, 20 as well as providing a plurality of seal points 42, 48, 50 52 which serve to prevent dust infiltration and eliminate vibration of panel member 24 within the frame assembly.

Hence, the present invention not only greatly facilitates installation and, additionally, permits use of a single panel mounting strip 26 along all edges of panel member 24, but it also provides a desirable "double" seal both along the inside and outside of the panel mounting strip 26 so as to greatly minimize dust, noise and vibration transmission around the panel member 24.

Certain modifications and improvements will occur to those skilled in the art upon reading of the aforegoing description. By way of example, other "wing-like" panel mounting designs which are functionally equivalent could be used, such as a heart-and-wing design or a "¢" design. Furthermore, panel assembly 10 is not limited to simple rectangular shapes but may include other geometries which use a series of straight line segments, for example, hexagonal and octagonal tabletops. It should be understood that all such modifications and improvements have been deleted herein for the sake of conciseness and readability but are properly within the scope of the following claims.

I claim:

1. A frame and strip assembly for mounting an edge portion of a panel, comprising;

(a) a frame member having a channel-like recess therewith for receiving the edge portion of the panel; and (b) a mounting strip adapted to be received in said recess, said strip having a base and a pair of opposed side walls defining a generally U-shaped cross section, said side walls having a substantially smooth surface of a sufficiently high durometer value adapted to slide freely in said frame member, wherein the upper portion of each of said side walls of said mounting strip defines a transversely and outwardly extending flange, whereby said outwardly extending flanges and said side walls of said mounting strip are adapted to be in substantially continuous and coextensive engagement with said frame member adjacent to said recess to suspend the edge portion of the panel in said frame member, thereby preventing physical contact between the panel edge and said frame member.

2. The mounting strip according to claim 1, wherein said mounting strip is formed from semi-rigid plastic.

3. The mounting strip according to claim 2, wherein said semi-rigid plastic has a durometer value of approximately 80.

4. The assembly according to claim 1, wherein the upper portion of said channel-like recess includes a pair of spaced apart upstanding side walls defining a mouth having a width which is slightly less than a corresponding dimension of said mounting strip.

5. The assembly according to claim 4, wherein the lower portion of said channel-like recess includes a base attached to said pair of spaced apart upstanding sidewalls defining a region of said channel-like recess having a depth which is slightly greater than the corresponding dimension of said mounting strip, thereby preventing the edge portion of the panel from contacting said base.

6. The assembly according to claim 4, wherein said upper portion of said channel-like recess further defines a transversely and outwardly extending surface, whereby said outwardly extending surface of said channel-like recess and said transversely and outwardly extending flanges of said mounting strip are in a substantially continuous and coextensive longitudinal engagement to firmly secure said mounting strip in said channel-like recess, thereby preventing movement between said mounting strip and said channel-like recess.

7. A strip for mounting an edge portion of a panel in a frame member having a channel-like recess therewith for receiving the edge portion of the panel, comprising: a pair of opposed side walls defining a generally U-shaped cross section, said side walls having a substantially smooth surface of a sufficiently high durometer value adapted to slide freely in said frame member, wherein the upper portion of each of said side walls of said mounting strip defines a transversely and outwardly extending flange, whereby said outwardly extending flanges and said side walls of said mounting strip are adapted to be in substantially continuous and coextensive engagement with said frame member adjacent to said recess to suspend the edge portion of the panel in said frame member, thereby preventing physical contact between the panel edge and said frame member.

8. The mounting strip according to claim 7, wherein the upper portion of each of said side walls of said mounting strip further defines a transversely and inwardly extending flange, whereby said inwardly extending flanges and said side walls of said mounting strip are adapted to be in substantially continuous and coextensive engagement with the panel adjacent to said recess to firmly secure the edge portion of the panel in said mounting strip, thereby preventing physical movement between the panel edge and said mounting strip.

9. The mounting strip according to claim 8, wherein said inwardly extending flanges are inclined slightly downwardly to facilitate insertion of the panel into said mounting strip.

10. The mounting strip according to claim 9, wherein said inwardly extending flanges are inclined downwardly approximately 15 degrees.

11. The mounting strip according to claim 8, wherein the upper portion of each of said side walls of said mounting strip, where they join to the respective flanges, defining a mouth opening having a width which is slightly less than a corresponding dimension of the panel.

12. The mounting strip according to claim 7, wherein said side walls of said mounting strip are approximately 40 mils thick.

13. The mounting strip according to claim 7, wherein said outwardly extending flanges of said mounting strip are approximately 40 mils thick.

14. The mounting strip according to claim 8, wherein said inwardly extending flanges are approximately 30 mils thick.

15. The mounting strip according to claim 7, wherein said mounting strip is formed from a semi-rigid plastic having a durometer value of approximately 80.

16. The mounting strip according to claim 15, wherein said semi-rigid plastic is PVC.

17. The mounting strip according to claim 15, wherein said mounting strip is formed by extrusion.

18. A mounting frame for a panel, comprising:

(a) a frame member having a channel-like recess therewith for receiving the edge portion of the panel; and (b) a mounting strip adapted to be received in said recess, said strip having a base and a pair of opposed side walls defining a generally U-shaped cross section, said side walls having a substantially smooth surface of a sufficiently high durometer value adapted to slide freely in said frame member, wherein the upper portion of each of said side walls of said mounting strip defines a transversely and outwardly extending flange, whereby said outwardly extending flanges and said side walls of said mounting strip are adapted to be in substantially continuous and coextensive engagement with said frame member adjacent to said recess to suspend the edge portion of the panel in said frame member, thereby preventing physical contact between the panel edge and said base of said strip with said frame member.

19. The mounting strip according to claim 18, wherein said mounting strip is formed from semi-rigid plastic.

20. The mounting strip according to claim 19, wherein said semi-rigid plastic has a durometer value of approximately 80.

21. The assembly according to claim 18, wherein the upper portion of said channel-like recess includes a pair of spaced apart upstanding side walls defining a mouth opening having a width which is slightly less than the corresponding dimension of said mounting strip.

22. The assembly according to claim 21, wherein the lower portion of said channel-like recess includes a base attached to said pair of spaced apart upstanding side walls defining a region of said channel-like recess having a depth which is slightly greater than the corresponding dimension of said mounting strip, thereby preventing the edge portion of the panel from contacting said base.

23. The assembly according to claim 21, wherein said upper portion of said channel-like recess further defines a transversely and outwardly extending surface, whereby said outwardly extending surface of said channel-like recess and said transversely and outwardly extending flanges of said mounting strip are in a substantially continuous and coextensive longitudinal engagement to firmly secure said mounting strip in said channel-like recess, thereby preventing movement between said mounting strip and said channel-like recess.

24. The mounting strip according to claim 18, wherein the upper portion of each of said side walls of said mounting strip further defines a transversely and inwardly extending flange, whereby said inwardly extending flanges and said side walls of said mounting strip are adapted to be in substantially continuous and coextensive engagement with the panel adjacent to said recess to firmly secure the edge portion of the panel in said mounting strip, thereby preventing physical movement between the panel edge and said mounting strip.

25. The mounting strip according to claim 24, wherein said inwardly extending flanges are inclined slightly downwardly to facilitate insertion of the panel into said mounting strip.

26. The mounting strip according to claim 25, wherein said inwardly extending flanges are inclined downwardly approximately 15 degrees.

27. The mounting strip according to claim 24, wherein the upper portion of each of said side walls of said mounting strip, where they join to the respective flanges, defining a mouth opening having a width which is slightly less than the corresponding dimension of the panel.

28. The mounting strip according to claim 18, wherein said side walls of said mounting strip are approximately 40 mils thick.

29. The mounting strip according to claim 18, wherein said outwardly extending flanges of said mounting strip are approximately 40 mils thick.

30. The mounting strip according to claim 24, wherein said inwardly extending flanges are approximately 30 mils thick.

31. The mounting strip according to claim 18, wherein said mounting strip is formed from semi-rigid plastic.

32. The mounting strip according to claim 31, wherein said semi-rigid plastic has a durometer value of approximately 80.

33. The mounting strip according to claim 32, wherein said semi-rigid plastic is PVC.

34. The mounting strip according to claim 31, wherein said mounting strip is formed by extrusion.

35. The mounting strip according to claim 24, wherein said flanges of said mounting strip and the panel cooperate with one another to simulate the edge of the panel to produce a visual effect wherein the panel appears substantially thicker than it actually is.

36. The mounting strip according to claim 35, wherein said visual effect produced by said mounting strip is most evident between 30 and 70 degrees normal to the panel.

* * * * *